US011367577B2

(12) United States Patent
Wong

(10) Patent No.: US 11,367,577 B2
(45) Date of Patent: Jun. 21, 2022

(54) LOCKING SYSTEM FOR USE WITH A TRIGGER ASSEMBLY OF AN ELECTRICAL DEVICE

(71) Applicants: Defond Electech Co., Ltd, Guangdong (CN); Defond Components Limited, Chai Wan (HK)

(72) Inventor: Kin Yu Wong, Chai Wan (HK)

(73) Assignees: DEFOND ELECTECH CO., LTD, Guangdong (CN); DEFOND COMPONENTS LIMITED, Chai Wan (HK)

( * ) Notice: Subject to any disclaimer, the term of this patent is extended or adjusted under 35 U.S.C. 154(b) by 0 days.

(21) Appl. No.: 16/733,616

(22) Filed: Jan. 3, 2020

(65) Prior Publication Data

US 2020/0219675 A1 Jul. 9, 2020

(30) Foreign Application Priority Data

Jan. 3, 2019 (HK) ..... 19100096.2

(51) Int. Cl.
*B25F 5/02* (2006.01)
*H01H 3/20* (2006.01)
(Continued)

(52) U.S. Cl.
CPC ..... *H01H 3/20* (2013.01); *H01H 9/06* (2013.01); *H01H 19/36* (2013.01); *B25F 5/02* (2013.01); *H01H 9/20* (2013.01)

(58) Field of Classification Search
CPC .. H01H 3/02; H01H 3/20; H01H 9/06; H01H 9/20; H01H 21/06; H01H 21/10; H01H 19/36; H01H 2300/024; B25F 5/02
See application file for complete search history.

(56) References Cited

U.S. PATENT DOCUMENTS 6,120,362 A * 9/2000 Etter ..... B25F 5/02 451/354
7,537,065 B2 * 5/2009 Gallagher ..... B24B 23/02 173/170
(Continued)

FOREIGN PATENT DOCUMENTS

CN 206277198 U 6/2017
CN 108252251 A 7/2018
(Continued)

OTHER PUBLICATIONS

Chinese Patentability Search Report dated Feb. 25, 2019, for HK Application Serial No. 19100096.2 filed Jan. 3, 2019 (5 pp.).
(Continued)

*Primary Examiner* — Vanessa Girardi
(74) *Attorney, Agent, or Firm* — Bryan D. Zerhusen; Nicholas R. Herrel, Esq.

(57) ABSTRACT

A trigger assembly having: a housing with a switch; a trigger; an actuator movable from OFF wherein the switch is operably-opened, towards ON wherein the switch is operably-closed; a lock-on mechanism including a first locking member mounted proximate the trigger and a second locking member mounted proximate the housing; when the actuator is ON, said locking members are movable relative to each other into a locked configuration; a lock-off mechanism including a lock-off member that is movable about a rotation axis between locked-off-position, which restricts movement of the trigger and the actuator is restricted from movement, and non-locked-off-position, which does not restrict movement of the trigger and the actuator member is not restricted from movement; and a shaped-portion disposed proximate the housing that abuts the lock-off member when the trigger is moved towards the housing with the
(Continued)

lock-off member in the locked-off-position, whereby the actuator is restricted from movement.

12 Claims, 14 Drawing Sheets

(51) Int. Cl.
*H01H 9/06* (2006.01)
*H01H 19/36* (2006.01)
*H01H 9/20* (2006.01)

(56) References Cited

U.S. PATENT DOCUMENTS 9,114,499 B2 * 8/2015 Zhang ..... B24B 23/028
9,855,651 B2 * 1/2018 Xin ..... B24B 23/028
2004/0148789 A1 * 8/2004 Gist ..... B23D 51/01 30/392
2009/0119933 A1 * 5/2009 Mace ..... A01G 3/085 30/381
2012/0048585 A1 * 3/2012 Miyazawa ..... B25F 5/02 173/170

FOREIGN PATENT DOCUMENTS

DE 19526591 A1 1/1997
EP 1759813 A2 3/2007
EP 2101340 A1 9/2009
EP 3415280 A1 12/2018

OTHER PUBLICATIONS

European Written Opinion; Application No. 20150034.5; 4 pages.
European Search Report; Application No. 20150034; dated Apr. 4, 2020; 2 pages.

* cited by examiner

LOCKING SYSTEM FOR USE WITH A TRIGGER ASSEMBLY OF AN ELECTRICAL DEVICE

CROSS-REFERENCE TO RELATED APPLICATIONS

The present Application claims the benefit of Hong Kong Patent Application No. 19100096.2, filed on Jan. 3, 2019, the contents of which are incorporated herein by reference.

TECHNICAL FIELD

The present invention relates to locking systems for locking-on and locking-off of a trigger of an electrical device such as a power tool, gardening tool and the like.

BACKGROUND OF THE INVENTION

It is sometimes required that a trigger-operated electrical device, such as an electric power tool, be continuously operated for an extended period of time at a desired speed setting. To alleviate fatigue in the user's finger operating the trigger, a "lock-on" mechanism is provided to allow locking of the power tool at the desired speed of operation without the user having to maintain pressure on the trigger. The same lock-on mechanism may also be configured to serve a dual-function as a "lock-off" mechanism—that is, a mechanism that is selectably movable into a locked-off position in which the trigger is prevented from being squeezed and the electric device is prevented from being turned on. One perceived problem with such dual-purpose lock-on/lock-off mechanisms is that a user may become confused and inadvertently deactivate the lock-off mechanism and allow the electric device to turn on causing harm to the user.

SUMMARY OF THE INVENTION

The present invention seeks to alleviate at least one of the above-described problems.

The present invention may involve several broad forms. Embodiments of the present invention may include one or any combination of the different broad forms herein described.

In one broad form, the present invention provides a trigger assembly for use with an electrical device, said electrical device having an electric switch housing with an electrical switch unit disposed therein, the trigger assembly including; a trigger member configured for movement relative to the housing; an actuator member operably-connected to the trigger member and, responsive to movement of the trigger member relative to the housing, said actuator member being movable in a first direction relative to the housing from an OFF position in which the electrical switch is operably-opened by the actuator towards an ON position in which the electrical switch is operably-closed by the actuator, and movable in a second direction relative to the housing from the ON position towards the OFF position; a lock-on mechanism including a first locking member mounted proximate to the trigger member and a second locking member mounted proximate to the housing, wherein when the actuator member is moved in to the ON position, said first and second locking members are selectably movable relative to each other into at least one of a locked configuration whereby the actuator member is locked in the ON position, and, an unlocked configuration whereby the actuator member is not locked in the ON position; and a lock-off mechanism including a lock-off member disposed on the trigger member, said lock-off member being rotatably movable about a first rotation axis between at least one of a locked-off position in which the lock-off member restricts movement of the trigger member relative to the housing and whereby the actuator member is restricted from being moved from the OFF position in to the ON position, and, a non-locked-off position in which the lock-off member does not restrict movement of the trigger member relative to the housing and whereby the actuator member is not restricted from being moved from the OFF position in to the ON position; and wherein the trigger assembly includes a shaped-portion disposed proximate to the housing wherein said shaped-portion is configured to abut against the lock-off member when the trigger member is moved towards the housing with the lock-off member rotatably arranged in to the locked-off position, whereby the actuator member is restricted from being moved from the OFF position in to the ON position.

Preferably, the lock-on mechanism and lock-off mechanism may be separate and independently operable of each other.

Preferably, when the lock-off member is rotated in to the locked-off position, a shaped-portion of the lock-off member may be configured for movement in to interference-fitting engagement with an engagement surface disposed on the trigger member or housing whereby the lock-off member is held in the locked-off position by the interference-fitting engagement of the shaped-portion of the lock-off member with the engagement surface.

Preferably, the first rotation axis may be substantially perpendicular to an elongate axis of the trigger member.

Preferably, the lock-off member may be configurable for rotational movement from the non-locked off position in to the locked-off position in either of a clockwise or an anti-clockwise direction about the first rotation axis.

Preferably, the present invention may include at least one stopper disposed on the trigger member, said stopper being configured for blocking rotation of the lock-off member beyond a predefined point of rotation about the first rotation axis relative to the trigger member when rotated from the non-locked-off position in to the locked-off position and/or when rotated from the locked-off position in to the non-locked off position.

Preferably, the lock-off member may include a biasing member configured for urging the lock-off member towards the non-locked-off position.

Preferably, the biasing member may include a torsion spring.

Preferably, when the lock-off member is arranged in the locked-off position, it may be configured to restrict movement of the trigger member relative to the housing when at least around 50 pounds of force is applied to the trigger member.

Preferably, the lock-off member may be configured to rotate about the first rotation axis relative to the trigger member within a recess disposed in the trigger member, whereby when the lock-off member is rotated in to the locked-off position a portion of the lock-off member may protrude outwardly of the recess and when the lock-off member is rotated in to the non-locked-off position, the lock off member is configured to form a substantially continuous surface with the trigger member over the recess.

Preferably, the first locking member of the lock-on mechanism may be rotatably mounted to the trigger member and is configured for rotation in a first direction about a second rotation axis relative to the trigger member in to the locked configuration whereby the actuator member is locked in the ON position, and, in a second direction about the second rotation axis in to the unlocked configuration whereby the actuator member is not locked in the ON position.

Preferably, the second rotation axis may be substantially perpendicular to a direction of movement of the actuator.

Preferably, the trigger member may be hingedly coupled relative to the housing and includes a biasing member configured for biasing movement of the trigger member about the hinge whereby the actuator is urged towards the OFF position.

BRIEF DESCRIPTION OF THE DRAWINGS

The present invention will become more fully understood from the following detailed description of a preferred but non-limiting embodiments thereof, described in connection with the accompanying drawings, wherein.

DETAILED DESCRIPTION OF THE PREFERRED EMBODIMENTS

Figure 1:
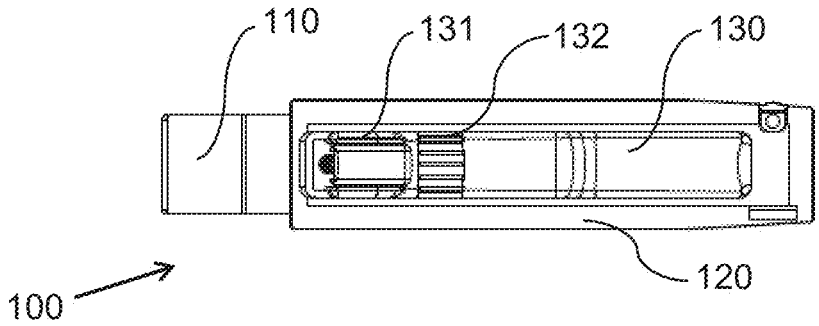
FIG. 1 shows a top view of a trigger assembly of an electrical device in accordance with a first embodiment of the present invention.
Figure 2:
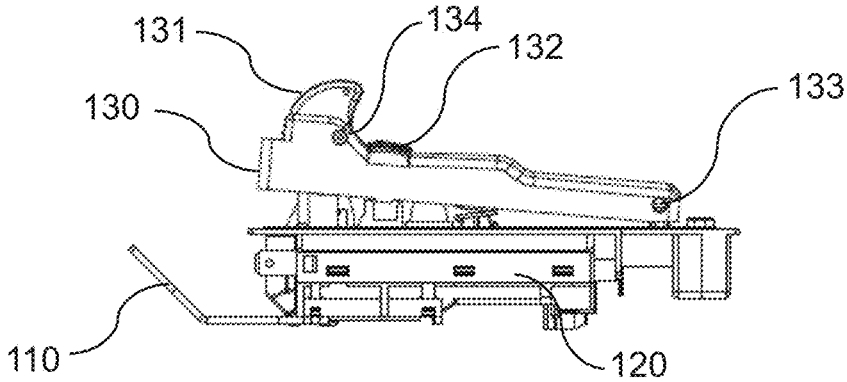
FIG. 2 shows a side-view of the first embodiment of the present invention.
Figure 3:
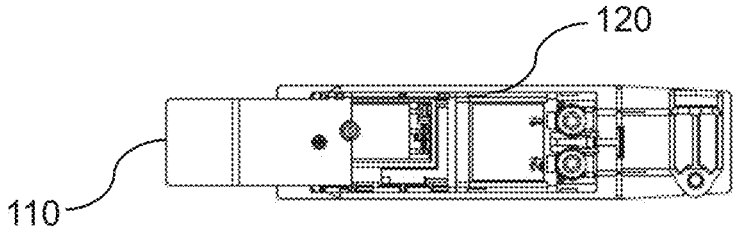
FIG. 3 shows a bottom view of the first embodiment of the present invention.
Figure 4:
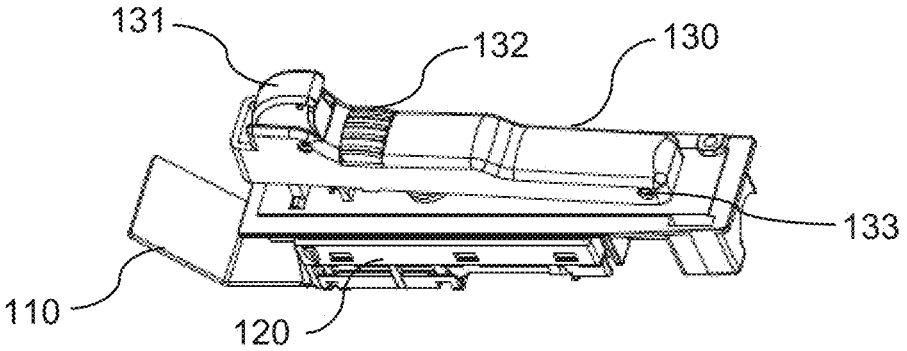
FIG. 4 shows a perspective view of the first embodiment of the present invention.
Figure 5:
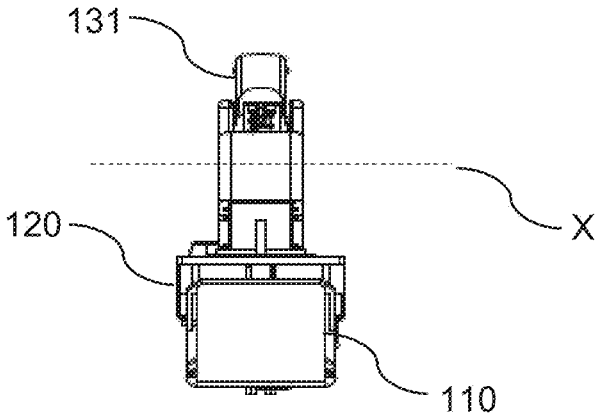
FIG. 5 shows a front view of the first embodiment of the present invention.
Figure 6:
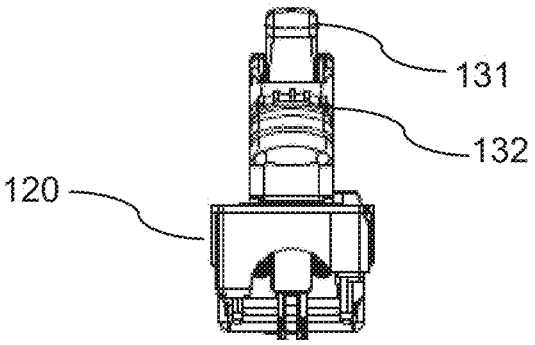
FIG. 6 shows a rear view of the first embodiment of the present invention.
Figure 7:
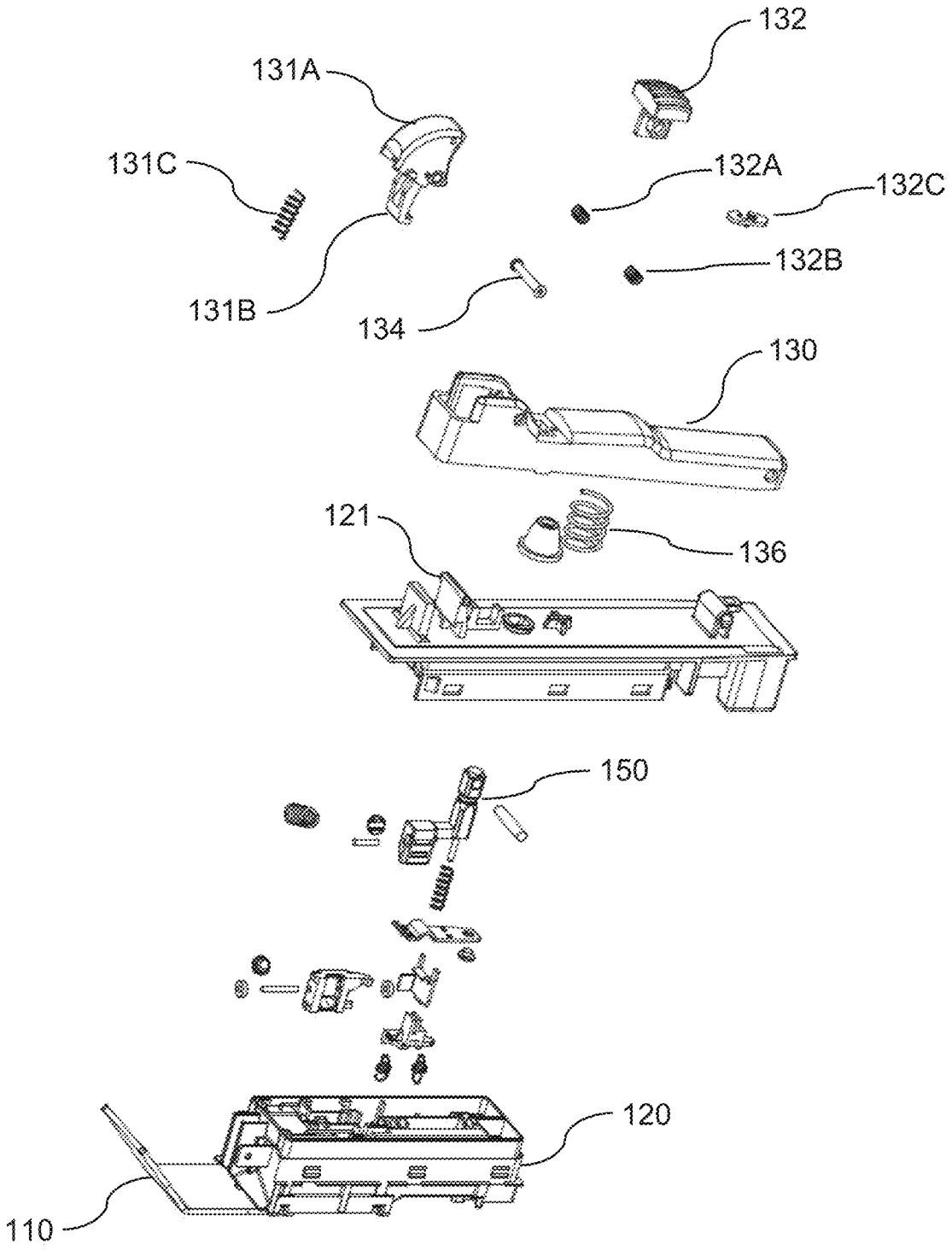
FIG. 7 shows an exploded view of the first embodiment of the present invention.
Figure 8A:
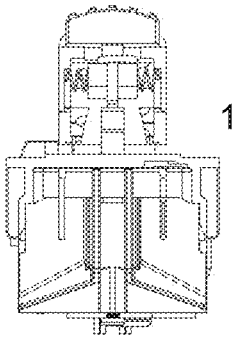
FIG. 8A shows a front cut-away view of the first embodiment of the present invention when a trigger member of the trigger assembly is not squeezed inwardly toward the housing and the actuator member is arranged in the OFF position whereby it operably-opens an electrical switch unit in the electrical switch housing.
Figure 8B:
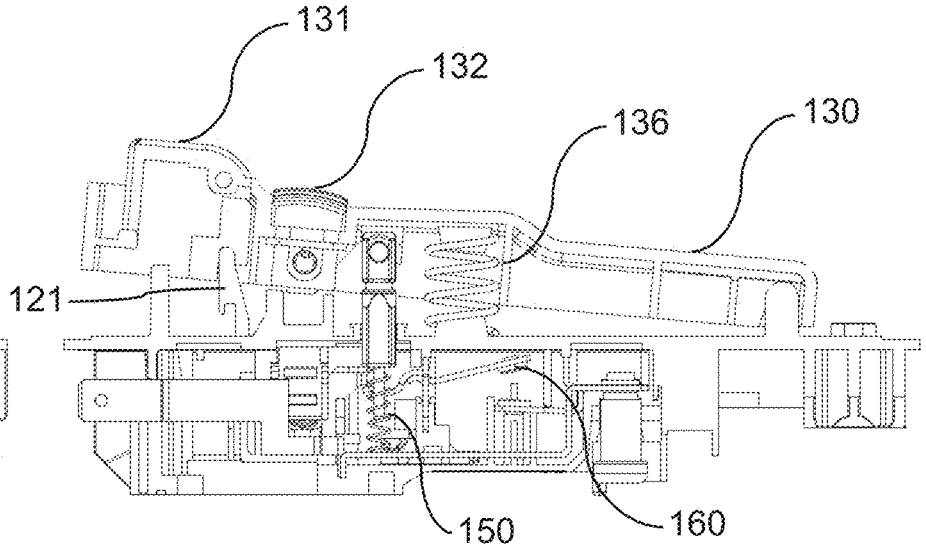
FIG. 8B shows a side cut-away view of the first embodiment of the present invention when the trigger member of the trigger assembly is not squeezed inwardly toward the housing and the actuator member is arranged in the OFF position whereby it operably-opens an electrical switch unit in the electrical switch housing.
Figure 8C:
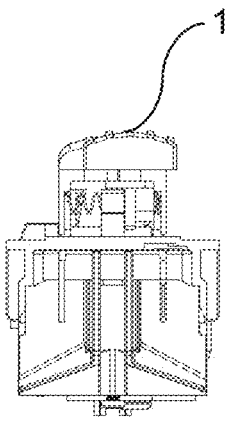
FIG. 8C shows a front cut-away view of the first embodiment of the present invention when the trigger member of the trigger assembly is squeezed inwardly toward the housing and the actuator member is arranged in the ON position whereby it operably-closes the electrical switch unit in the electrical switch housing.
Figure 8D:
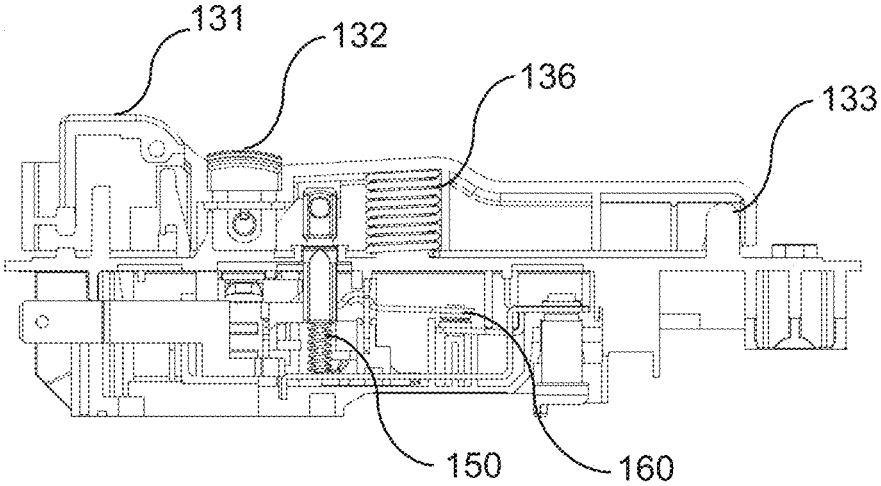
FIG. 8D shows a side cut-away view of the first embodiment of the present invention when the trigger member of the trigger assembly is squeezed inwardly toward the housing and the actuator member is arranged in the ON position whereby it operably-closes the electrical switch unit in the electrical switch housing.

Preferred embodiments of the present invention will now be described herein with reference to FIGS. 1 to 19. The embodiments comprise a variable-speed trigger assembly (100) for use with an electric power tool having an electric motor including for instance an electric drill, grinder, sander, saw, rotary driving tool and the like. More particularly, the embodiments described herein comprise variable-speed trigger assemblies having a locking system to provide both lock-on and lock-off functions. It would be appreciated and understood that whilst this embodiment is described for use with an electric power tool, this is merely for purposes of illustrating functionality and alternate embodiments of the present invention may of course be used with other types of electric devices such as gardening tools.

The variable-speed trigger assembly (100) includes a hand-operable trigger member (130) that is rotatably movable about a hinge (133) relative to an electrical switch housing (120). A return spring (136) biases the trigger member (130) so that it is urged in a direction away from the housing (120). The housing (120) is molded from a rigid plastic material and is mounted on a body (110) of the electric power tool near to a handle of the electric power tool. The housing (120) encloses an electrical switch unit (160) comprising movable and stationary electrical switching contacts (160) that are arranged in series in an electrical circuit between a brushless DC motor and a DC power source (e.g. a battery pack) of the electric power tool.

The trigger member (130) is also operably-connected to an actuator member (150) whereby, when the trigger member (130) is squeezed towards the housing (120), the actuator member (150) is configured to move in a direction inwardly of the housing (120) from an OFF position towards an ON position. When the user's hand releases the trigger member (130), the return spring (136) urges the trigger member (130) in a direction away from the housing (120), and consequently, the actuator member (150) is also caused to move in a direction outwardly of the housing (120) from the ON position toward the OFF position. The actuator-member (120) is operably-connected to the electrical switching contacts (160) such that in response to the actuator member (150) being moved in to the ON position, the electrical switching contacts (160) are moved in to a closed-circuit arrangement whereby power from the DC power source can be supplied to the brushless DC motor via the pair of electrical switching contacts (160). Conversely, in response to the actuator member (150) being moved back in to the OFF position by movement of the trigger member (130) away from the housing (120), the pair of electrical switching contacts (160) are moved in to an opened-circuit configuration whereby the DC power source is not able to supply power to the brushless DC motor via the pair of electrical switching contacts (160). The actuator member (150) is also movable through a range of ON positions inwardly of the housing (120) depending upon the amount of squeezing force applied to the trigger member (130) by the user's hand and the DC motor is configured to operate at variable speeds of operation depending upon the degree of movement of the actuator member (150) inwardly of the housing. It would be understood that in the embodiments described herein, a hinged trigger member is utilised which is configured to move rotatably about the hinge relative to the housing. However, in alternate embodiments, the trigger member may be configured in a pistol-type trigger or any other type of trigger configured for movement relative to the housing other than by rotational or sliding movement.

The lock-on mechanism of the locking system obviates the need for the user to keep squeezing the trigger member (130) at any given speed setting position of the trigger member (130) in order to maintain operation of the electric power tool at that speed of operation. The lock-on mechanism includes a first locking member (131) that is rotatably mounted about another hinge (134) located on the trigger member (130), and, a second locking member (121) that is rigidly mounted on the electric power tool body next to the housing (120). When the trigger member (130) has been squeezed towards the housing (120) and the actuator member (150) has been operably-moved in to the ON position by movement of the trigger member (130), the first locking member (131) of the lock-on mechanism may then be rotated about the hinge (134) in a first direction into a locked configuration with the second locking member (121). The first locking member (131) includes a user contact surface (131A), for instance configured for the user's thumb to control rotational movement of the first locking member (131) about the hinge (134). The user contact surface may include ribbing or other surface texture disposed thereon to allow for gripping by the user's thumb. The first locking member (131) may include a first shaped-portion (131B) that is configured for releasably latching on to a suitably configured second shaped-portion (121) on the second locking member (121) when the first locking member (131) is rotated about the trigger member (130) in to the locked configuration. When in the locked configuration, a return spring (131C) of the first locking member (131) assists in urging the first-shaped portion (131B) of the first locking member (131) against the second shaped-portion (121) of the second locking member (121) so that they may remain in the locked configuration even when the user stops squeezing the trigger member (130). Consequently, the actuator member (150) remains locked in the ON position indefinitely.

Thereafter, the first locking member (131) may be moved out of the locked configuration with the second locking member (121) by squeezing the trigger member (130)

towards the housing (120) again such that the first shaped-portion (131B) on the first locking member (131) may unlatch itself from the second shaped-portion (121) on the second locking member (121) and then be free to rotate in a second (e.g. reverse) direction about the hinge (134) in to an unlocked configuration with the second locking member (121). In the unlocked configuration, when the user ceases squeezing of the trigger member (130), the trigger member (130) is able to freely rotate about the hinge (133) away from the housing (120) by urging of the trigger member return spring (136), and in turn, the actuator member (150) that is operably-connected to the trigger member (130) is also moved in a direction outwardly of the housing (120) from the ON position in to the OFF position.

In this embodiment, the axis of rotation (X) about which the first locking member (131) rotates is substantially perpendicular to a direction of movement of the actuator member (150). However, the direction and orientation of rotation of the first locking member (131) may be varied if desired. Furthermore, in certain embodiments, the lock-on mechanism may be implemented using other suitable arrangements, such as for instance, using a spring-loaded first locking member (131) that is configured for slidable movement relative to the second locking member (121) in order to the interlocked configuration with the second locking member (121).

The lock-off mechanism of the locking system includes a lock-off member (132) disposed on the trigger member (130). The lock-off member (132) is selectably movable between a locked-off position in which the lock-off member (132) restricts movement of the trigger member (132) relative to the housing (120) and whereby the actuator member (150) is restricted from being moved from the OFF position in to the ON position, and, a non-locked-off position in which the lock-off member does not restrict movement of the trigger member (130) relative to the housing (120) and whereby the actuator member (150) is not restricted from being moved from the OFF position in to the ON position. In this embodiment, a shaped portion extending from the housing may be configured to prevent movement of the lock-off member in a direction towards the housing when the lock-off member is slidably arranged in the relatively central locked-off position along the sliding axis (Y). That is, as shown in FIG. 9, the lock-off member is not able to move downwardly towards the housing and consequently, this restricts rotational movement of the trigger member towards the housing as well.

Figure 10:
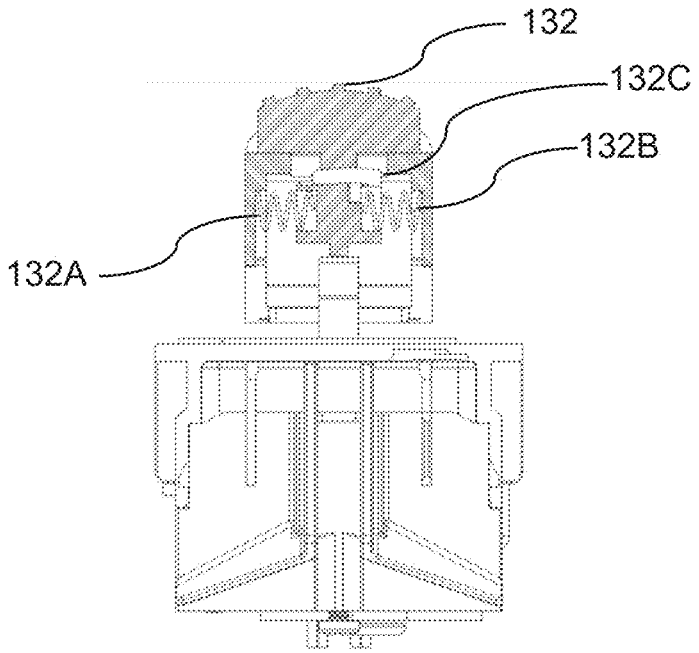
FIG. 10 shows a front cut-away view of the first embodiment the present invention depicting the lock-off mechanism in greater detail.
Figure 11:
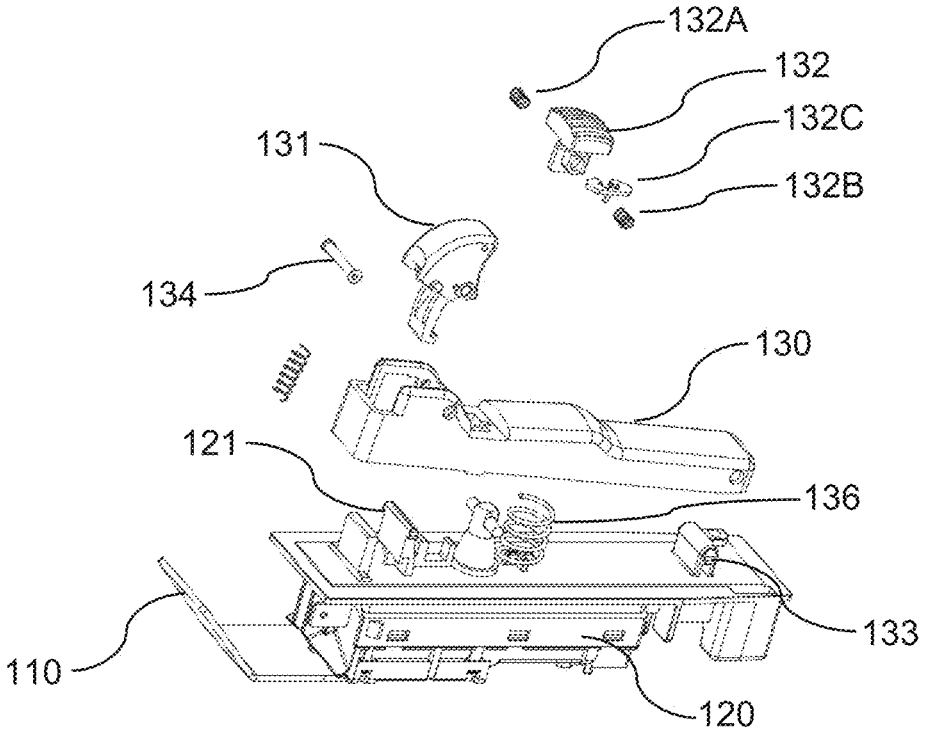
FIG. 11 shows an exploded perspective view of the first embodiment of the present invention.
Figures 12A, 12B, 12C, 12D, 12E, 12F:
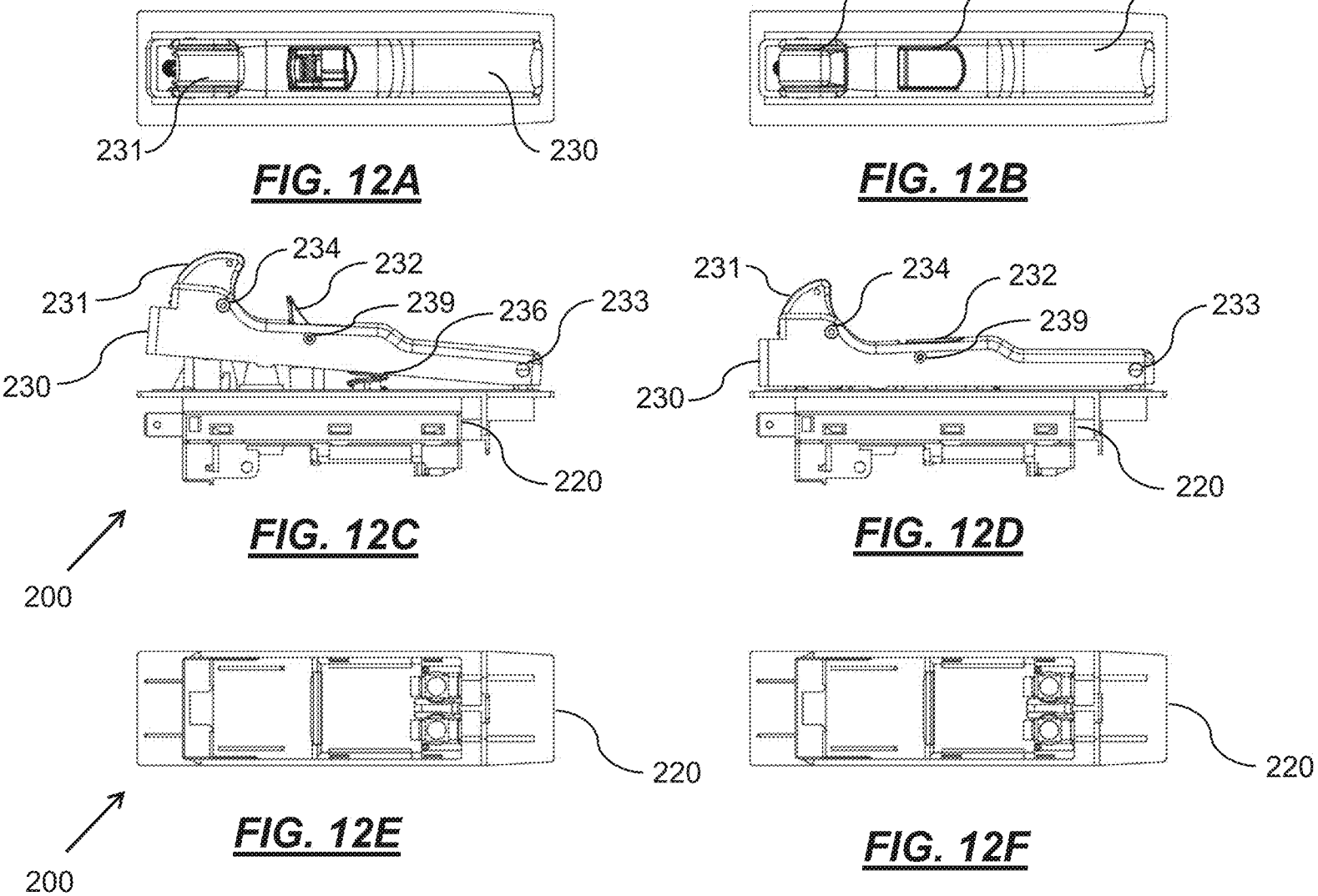
FIG. 12A shows a top view of a second embodiment of the trigger assembly with a forward rotating lock-off member arranged in a locked-off position and with the trigger assembly arranged in the OFF position.
FIG. 12B shows a top view of the second embodiment of the trigger assembly with a forward rotating lock-off member arranged in a non-locked-off position and with the trigger assembly arranged in the ON position.
FIG. 12C shows a side view of the second embodiment of the trigger assembly with a forward rotating lock-off member arranged in a locked-off position and with the trigger assembly arranged in the OFF position.
FIG. 12D shows a top view of the second embodiment of the trigger assembly with a forward rotating lock-off member arranged in a non-locked-off position and with the trigger assembly arranged in the ON position.
FIG. 12E shows a bottom view of the second embodiment of the trigger assembly with a forward rotating lock-off member arranged in a locked-off position and with the trigger assembly arranged in the OFF position.
FIG. 12F shows a bottom view of the second embodiment of the trigger assembly with a forward rotating lock-off member arranged in a non-locked-off position and with the trigger assembly arranged in the ON position.
Figure 13:
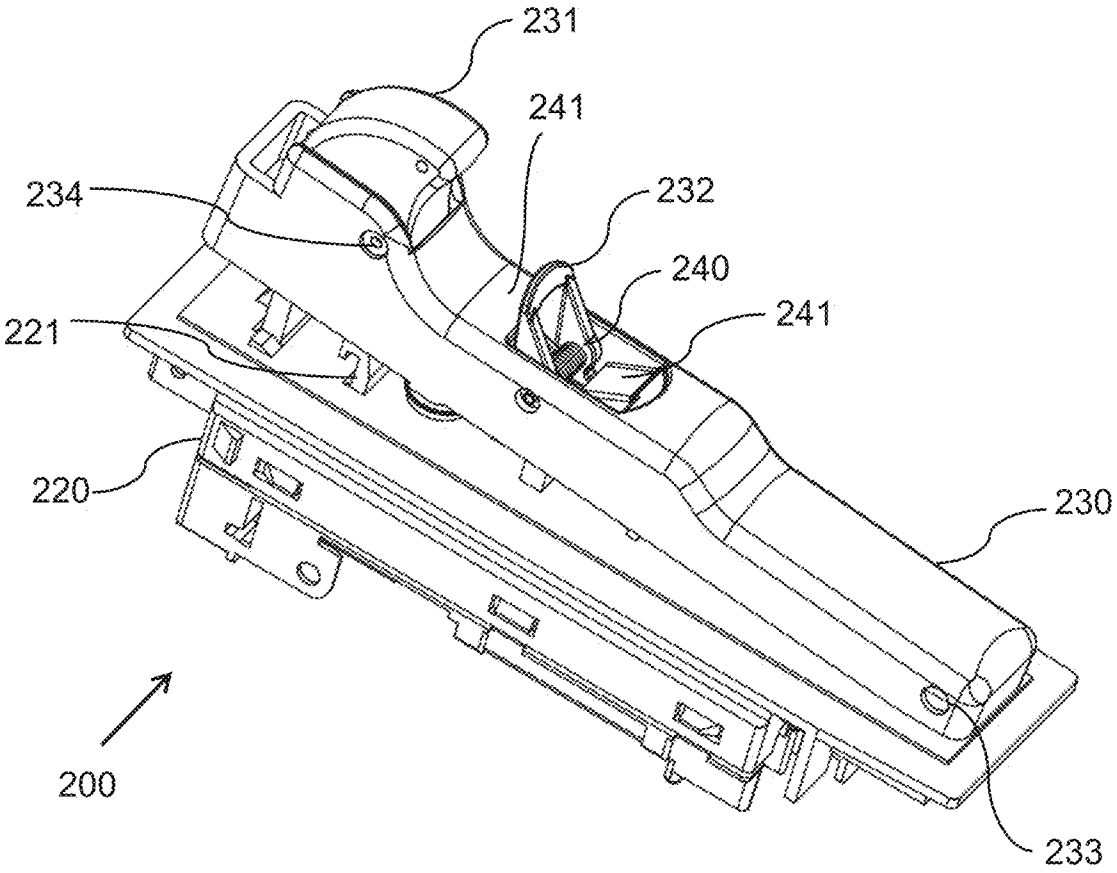
FIG. 13 shows a perspective view of the second embodiment of the trigger assembly with a forward rotating lock-off member arranged in a locked-off position and with the trigger assembly arranged in the OFF position.
Figure 14B:
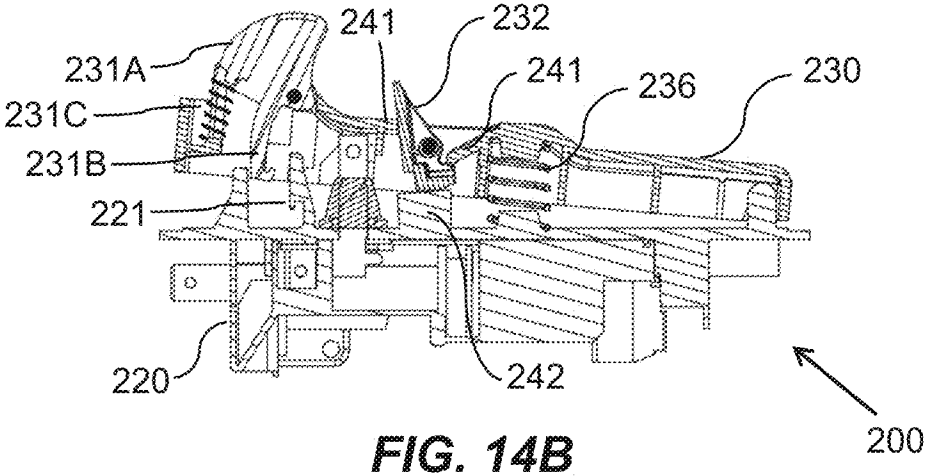
FIG. 14B shows a side cut-away view of the second embodiment of the trigger assembly with a forward rotating lock-off member arranged in a locked-off position and with the trigger assembly arranged in the OFF position.
Figure 14A:
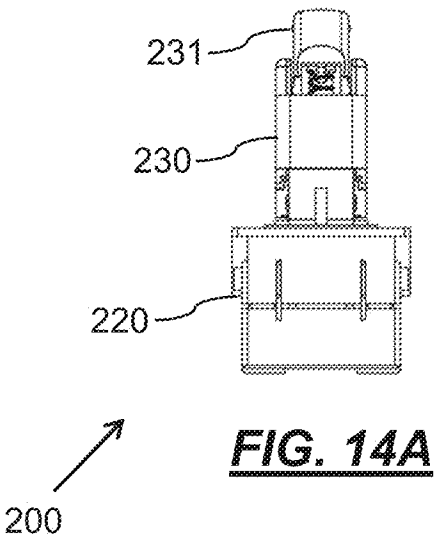
FIG. 14A shows a front view of the second embodiment of the trigger assembly with a forward rotating lock-off member arranged in a locked-off position and with the trigger assembly arranged in the OFF position.
Figure 14D:
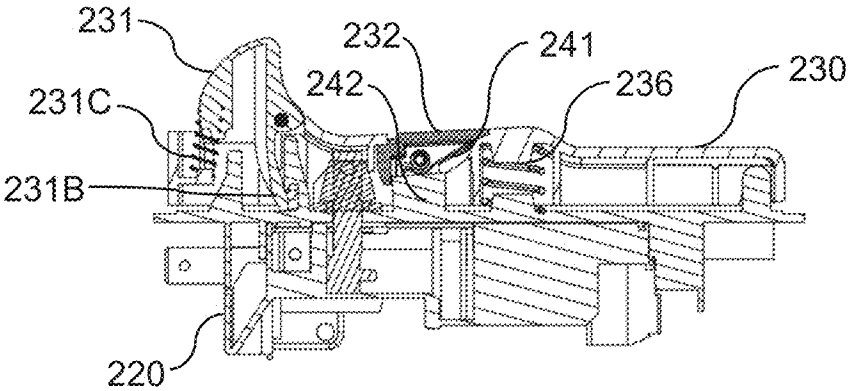
FIG. 14D shows a side cut-away view of the second embodiment of the trigger assembly with a forward rotating lock-off member arranged in a non-locked-off position and with the trigger assembly arranged in the ON position.
Figure 14C:
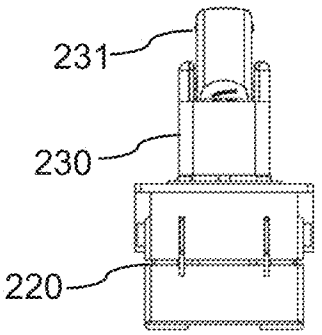
FIG. 14C shows a front view of the second embodiment of the trigger assembly with a forward rotating lock-off member arranged in a non-locked-off position and with the trigger assembly arranged in the ON position.
Figure 15:
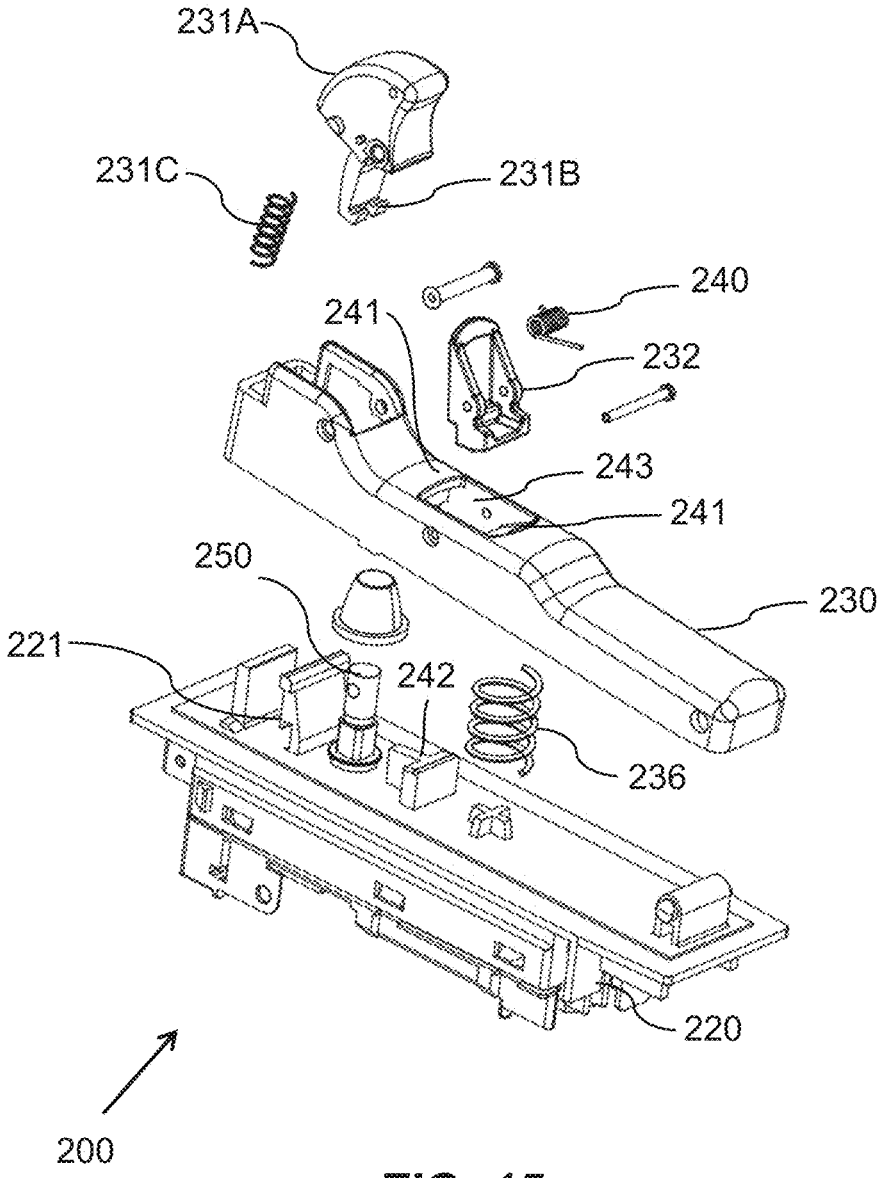
FIG. 15 shows an exploded view of the second embodiment of the trigger assembly with a forward rotating lock-off member.
Figure 16A:
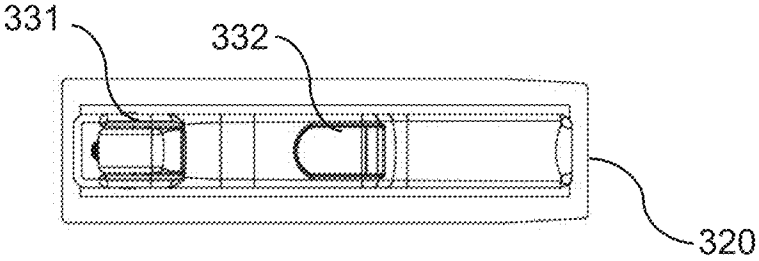
FIG. 16A shows a top view of a third embodiment of the trigger assembly with a backwards rotating lock-off member arranged in a non-locked-off position and with the trigger assembly arranged in the ON position.
Figure 16B:
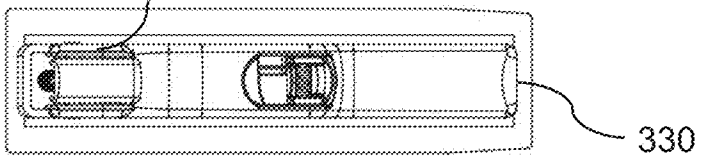
FIG. 16B shows a top view of the third embodiment of the trigger assembly with a backwards rotating lock-off member arranged in a locked-off position and with the trigger assembly arranged in the OFF position.
Figure 16C:
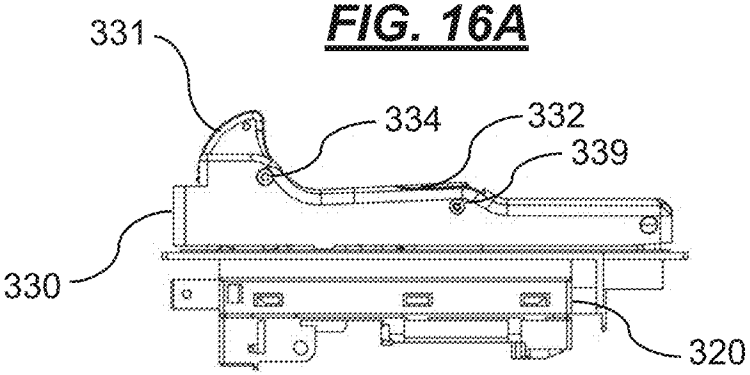
FIG. 16C shows a side view of the third embodiment of the trigger assembly with a backwards rotating lock-off member arranged in a non-locked-off position and with the trigger assembly arranged in the ON position.
Figure 16D:
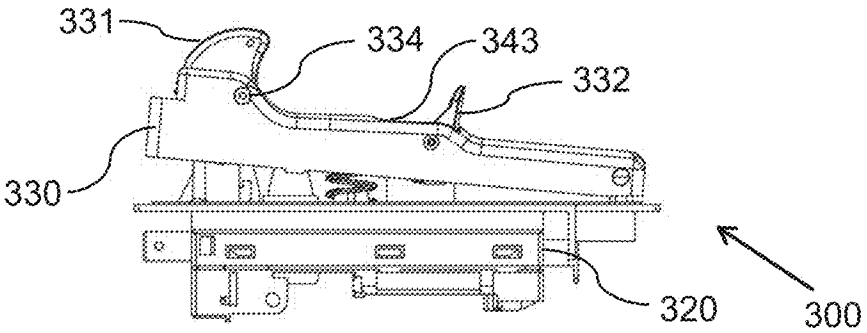
FIG. 16D shows a side view of the third embodiment of the trigger assembly with a backwards rotating lock-off member arranged in a locked-off position and with the trigger assembly arranged in the OFF position.
Figure 16E:
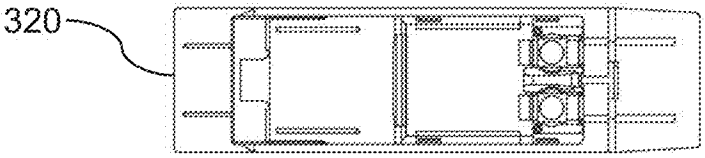
FIG. 16E shows a bottom view of the third embodiment of the trigger assembly with a backwards rotating lock-off member arranged in a non-locked-off position and with the trigger assembly arranged in the ON position.
Figure 16F:
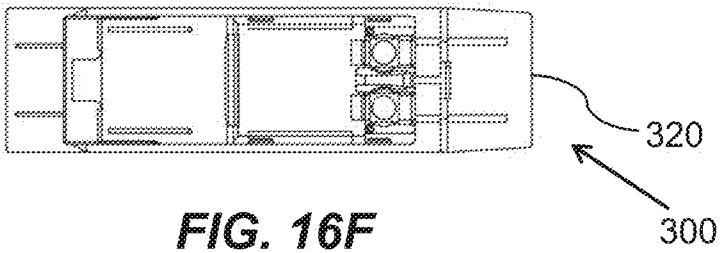
FIG. 16F shows a bottom view of the third embodiment of the trigger assembly with a backwards rotating lock-off member arranged in a locked-off position and with the trigger assembly arranged in the OFF position.
Figure 17:
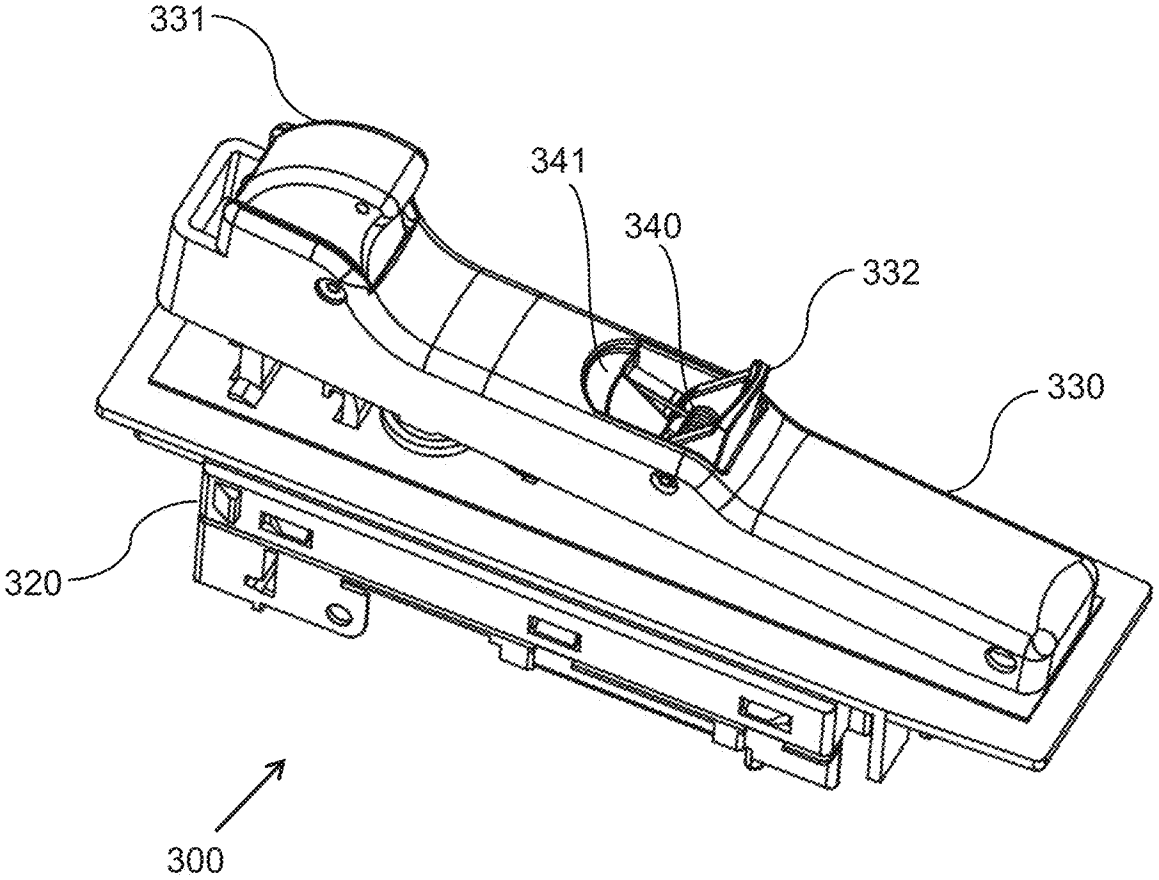
FIG. 17 shows a perspective view of the third embodiment of the trigger assembly with a backwards rotating lock-off member arranged in a locked-off position and with the trigger assembly arranged in the OFF position.
Figure 18B:
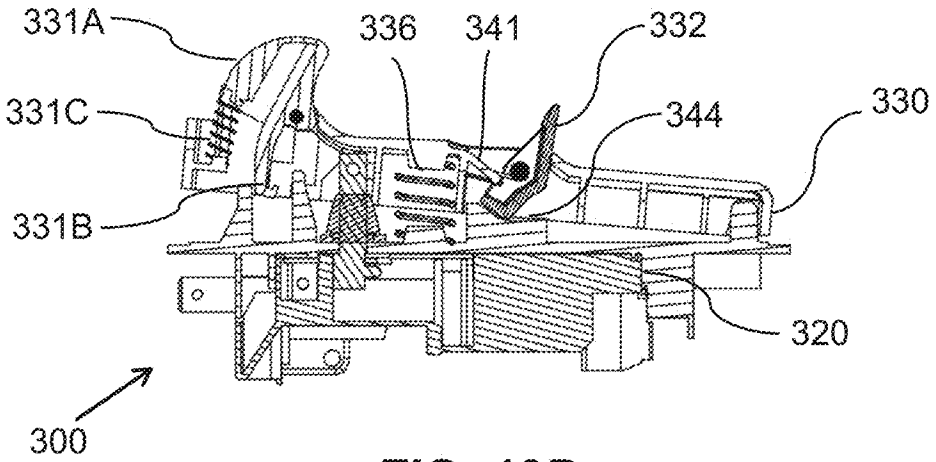
FIG. 18B shows a side cut-away view of the third embodiment of the trigger assembly with a backwards rotating lock-off member arranged in a locked-off position and with the trigger assembly arranged in the OFF position.
Figure 18D:
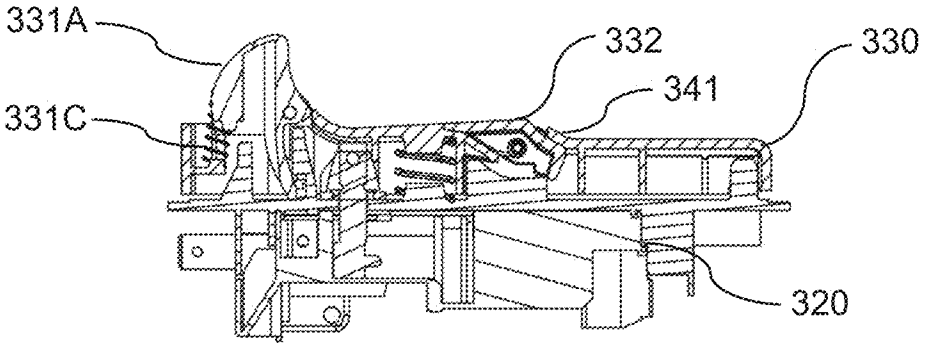
FIG. 18D shows a side cut-away view of the third embodiment of the trigger assembly with a backwards rotating lock-off member arranged in a non-locked-off position and with the trigger assembly arranged in the ON position.
Figure 18A:
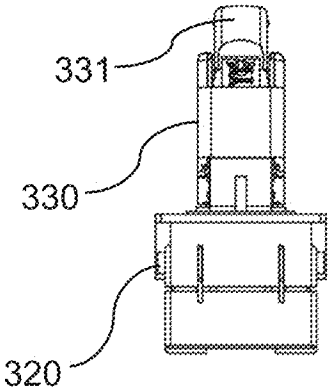
FIG. 18A shows a front view of the third embodiment of the trigger assembly with a backwards rotating lock-off member arranged in a locked-off position and with the trigger assembly arranged in the OFF position.
Figure 18C:
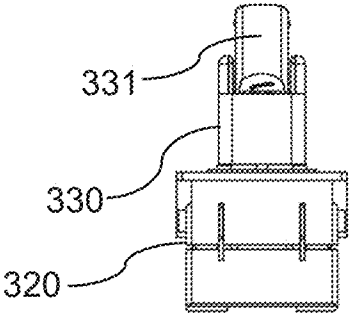
FIG. 18C shows a front view of the third embodiment of the trigger assembly with a backwards rotating lock-off member arranged in a non-locked-off position and with the trigger assembly arranged in the ON position.
Figure 19:
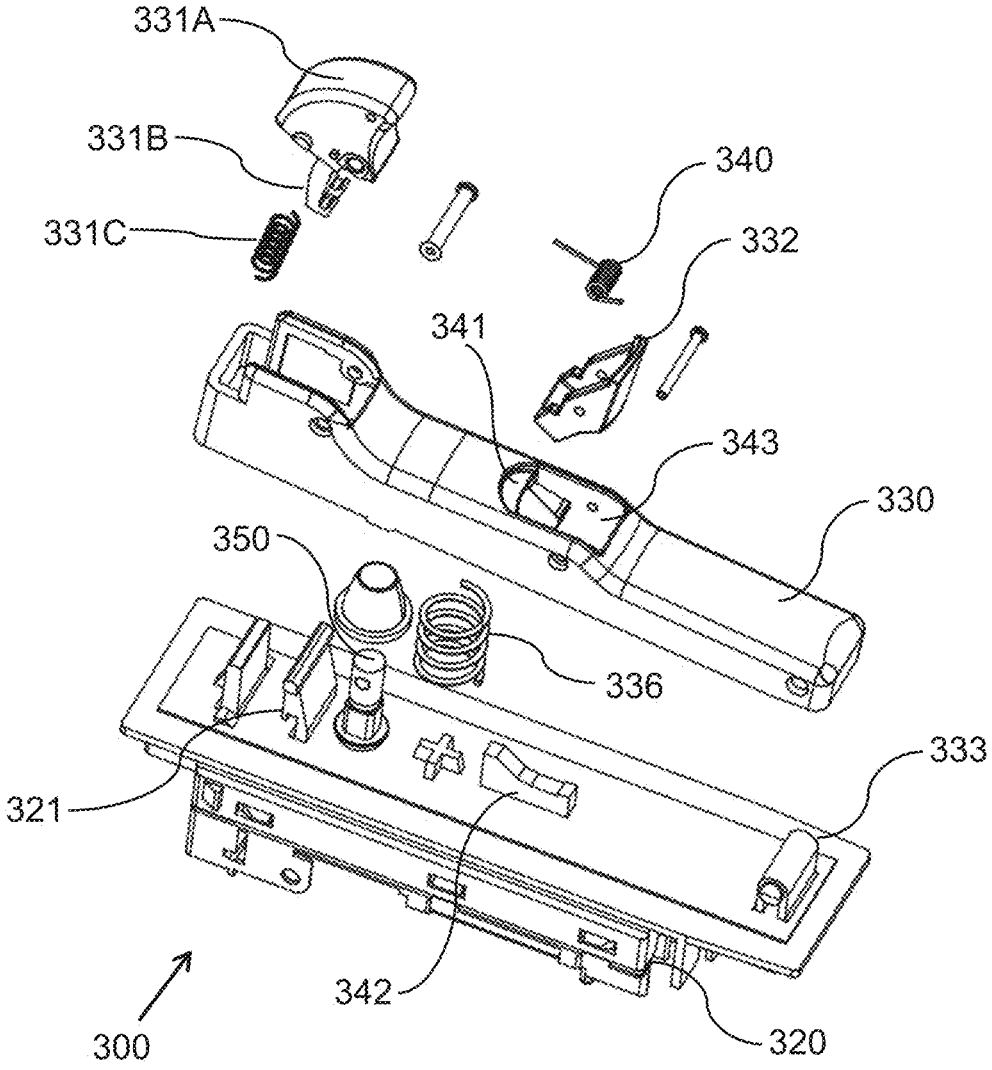
FIG. 19 shows an exploded view of the third embodiment of the trigger assembly with a backwards rotating lock-off member.

The lock-off member (132) of the lock-off mechanism is slidably mounted to the trigger member (130) and is configured for slidable movement relative to the trigger member (130) along a sliding axis (Y) between the locked-off and non-locked-off positions. In these embodiments, the sliding axis (Y) is substantially parallel to the rotation axis (X) of the first locking member (131) about its hinge (134). The lock-off member (132) is in the locked-off position when arranged in a relatively central position along the sliding axis (Y) and the lock-off member (132) is in the non-locked-off position when slidably arranged in a position along the sliding axis (Y) on either side of the relatively central position. As shown in FIGS. 10 and 11, the lock-off mechanism includes two return springs (132A,132B) mounted on either side of the lock-off member (132) and which extend in substantially axial alignment with the sliding axis (Y) of the lock-off member (132). The return springs (132A,132B) are configured to urge the lock-off member (132) in to the relatively central position along the sliding axis (Y) as a default position. The lock-off member (132) is slidably mounted on the trigger member (130) next to the first locking member (131) of the lock-on mechanism so that a user's thumb may conveniently contact and operate both the lock-on and lock mechanisms without having to adjust positioning of the user's hand on the trigger member (130) in use. The lock-off member (132) is also rated to withstand forces of at least around 50 pounds applied to the trigger member (130) when arranged in the locked-off position. A metal fastener (132C) such as an "E-clip", "E-ring" or the like is clipped in to position around a stem of the lock-off member (132) between the lock-off member (132) and the trigger member (130) and is acted upon by the return springs (132A,132B) so as to move the fastener (132C) together with the lock-off member (132). Advantageously, the presence of the fastener (132C) between the lock-off member (132) and the trigger member (130) may assist in withstanding the force applied to the trigger member (130) when the lock-off member (132) is arranged in the locked-off position.

Figure 9:
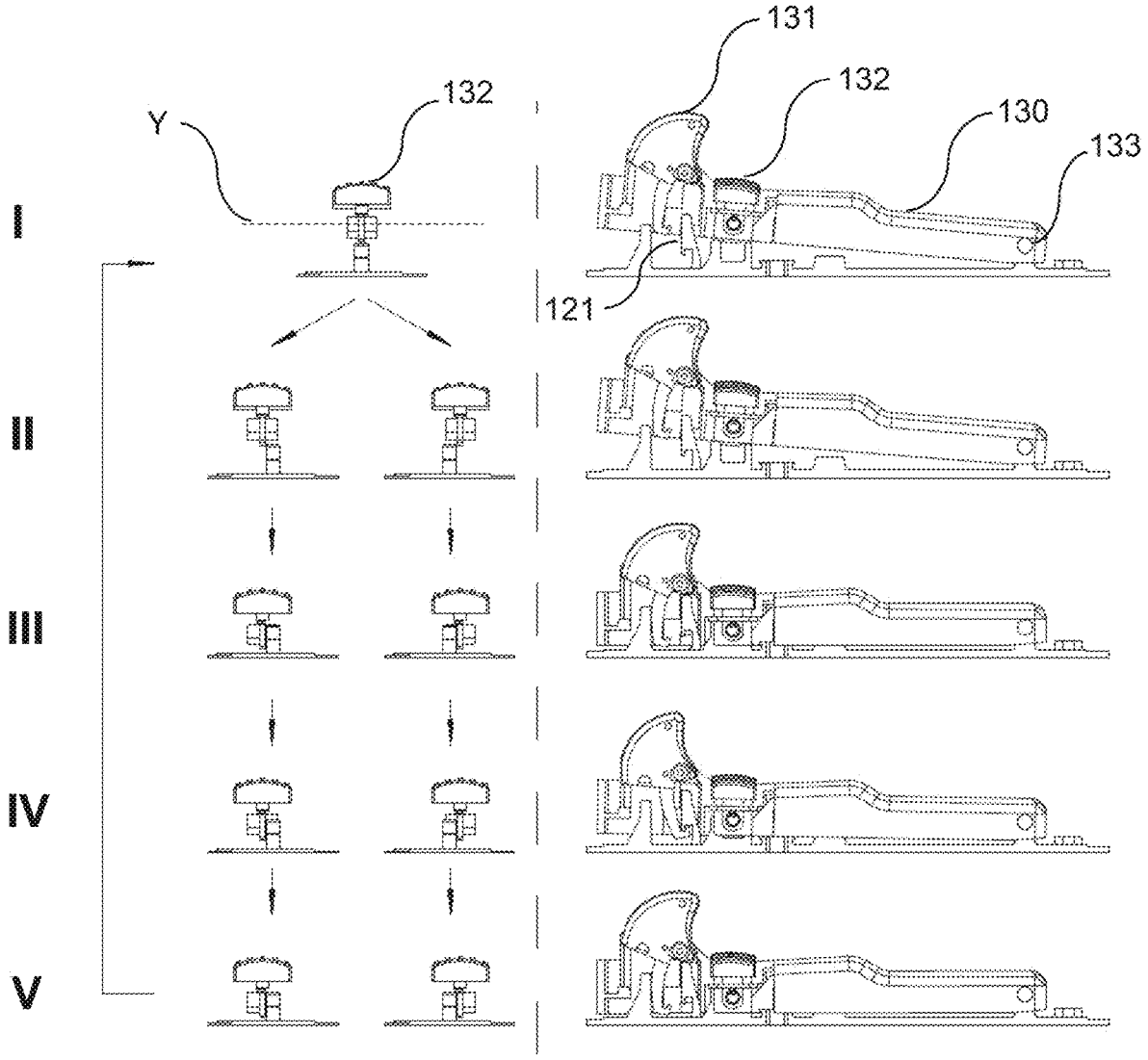
FIG. 9 illustrates operation of a lock-off mechanism in accordance with the first embodiment of the present invention.

FIG. 9 depicts example steps (I-V) in the operation of the lock-off mechanism. In FIG. 9, step I involves the lock-off member (132) being arranged in a relatively central position along the sliding axis (Y) whereby the lock-off member (132) restricts rotational movement of the trigger member (130) about the hinge (133) towards the housing (120). In FIG. 9, step II involves the lock-off member (132) shown being slidably moved on either side of the central position along the sliding axis (Y). In this non-locked-off position, the trigger member (130) is ready and able to now be squeezed against the housing (120) without restriction by the lock-off member (132). In FIG. 9, step III involves the trigger member (130) being rotated towards the housing (120) and, as is depicted in the far right of the image, the first locking member (131) of the lock-on mechanism being arranged in an unlocked configuration with the second locking member (121) so that the trigger member (130) may still freely rotate away from the housing (120) if the user's releases its grip upon the trigger member (130). In FIG. 9, step IV shows the position of the lock-off member (132) slightly raised higher than as shown in step III as the first locking member (131) of the lock-on mechanism has been rotated about in to the locked configuration with the second locking member (121) and the return spring (131C) of the first locking member (131) urges the first shaped-portion (131B) of the first locking member (131) upwardly into latching engagement with the second-shaped portion (121) of the second locking member (121). In FIG. 9, step V the position of the lock-off member (132) is slightly lower than as shown in step IV as the trigger member (130) has been squeezed towards the housing (120) acting against the trigger member (130) return spring (136) to allow the first shaped-portion (131B) on the first locking member (131) of the lock-on mechanism to unlatch itself from the second shaped-portion (121) on the second locking member (121) of the lock-on mechanism. As can be seen, the first locking member (131) of the lock-on mechanism is rotated away from the second locking member (121) into the unlocked configuration whereby the trigger member (130) may now freely rotate about the hinge (133) away from the housing (120) again by urging of the return spring (136).

Further variable-speed trigger assembly embodiments (200,300) are shown in FIGS. 12A-19 each having locking systems to provide both lock-on and lock-off functions. As with the above-described embodiment, the alternate variable-speed trigger assemblies (200,300) include hand-operable trigger members (230,330) that are rotatably movable about hinges (233,333) relative to electrical switch housings (220,320). Return springs (236,336) bias the trigger members (230,330) so that they are urged in directions away from the housings (220,320). The housings (220,320) are molded from rigid plastic materials and are mounted on bodies of electric power tools near to handles of the electric power tools. The housings (220,320) each enclose electrical switch units comprising movable and stationary electrical switching contacts that are arranged in series in electrical circuits between brushless DC motors and DC power sources (e.g. a battery pack) of the electric power tools. The trigger members (230,330) are also operably-connected to actuator members (250,350) whereby, when the trigger members (230,330) are squeezed towards the housings (220,320), the actuator members (250,350) are configured to move in directions inwardly of the housings (220,320) from OFF positions towards ON positions. When the user's hand releases the trigger members (230,330), the return springs (236,336) urge the trigger members (230,330) in directions away from the housings (220,320), and consequently, the actuator members (250,350) are also caused to move in directions outwardly of the housings (220,320) from the ON positions toward the OFF positions. The actuator-members (220,320) are operably-connected to the electrical switching contacts such that in response to the actuator members (250,350) being moved in to the ON positions, the electrical switching contacts are moved in to closed-circuit arrangements whereby power from the DC power sources can be supplied to the brushless DC motors via the pairs of electrical switching contacts. Conversely, in response to the actuator members (250,350) being moved back in to the OFF positions by movement of the trigger members (230, 330) away from the housings (220,320), the pairs of electrical switching contacts are moved in to opened-circuit configurations whereby the DC power sources are not able to supply power to the brushless DC motors via the pairs of electrical switching contacts. The actuator members (250, 350) are also movable through range of ON positions inwardly of the housings (220,320) depending upon the amount of squeezing force applied to the trigger members (230,330) by the user's hand and the DC motors are configured to operate at variable speeds of operation depending upon the degree of movement of the actuator members (250,350) inwardly of the housings (220,320). It would be understood that in the embodiments described herein, hinged triggers member (230,330) are utilised which are configured to move rotatably about the hinges relative to the housings (220,320). However, in alternate embodiments, the trigger members may be configured in a pistol-type trigger or any other type of trigger mechanism configured for movement relative to the housing other than by rotational or sliding movements.

The lock-on mechanisms include first locking members (231,331) that are rotatably mounted about hinges (234,334) located on the trigger members (230,330), and, second locking members (221,321) that are rigidly mounted on the electric power tool bodies next to the housings (220,320). When the trigger members (230,330) have been squeezed towards the housings (220,320) and the actuator members (250,350) have been operably-moved in to the ON positions by movement of the trigger members (230,330), the first locking members (231,331) of the lock-on mechanisms may then be rotated about the respective hinges (234,334) in first directions into locked configurations with the second locking members (221,321). The first locking members (231, 331) include user contact surfaces (231A,331A), for instance configured for the user's thumb to control rotational movement of the first locking members (231,331) about the hinges (234,334). The user contact surfaces may include ribbings or other surface textures disposed thereon to allow for gripping by the user's thumb. The first locking members (231,331) may include first shaped-portions (231B,331B) that are configured for releasably latching on to a suitably configured second shaped-portions (221,321) on the second locking members (221,321) when the first locking members (231,331) are rotated about the trigger members (230,330) in to the locked configurations. When in the locked configurations, return springs (231C,331C) of the first locking members (231,331) assist in urging the first-shaped portions (231B,331B) of the first locking members (231,331) against the second shaped-portions (221,321) of the second locking members (221,321) so that they may remain in the interlocked configurations even when the user stops squeezing the trigger members (230,330). Consequently, the actuator members (250,350) remains locked in the ON position indefinitely.

Thereafter, the first locking members (231,331) may be moved out of the locked configurations with the second locking members (221,321) by squeezing the trigger members (230,330) towards the housings (220,320) again such that the first shaped-portions (231B,331B) on the first locking members (231,331) may unlatch themselves from the second shaped-portions (221,321) on the second locking members (221,321) and then be free to rotate in a second (e.g. reverse) directions about the hinges (234,334) in to unlocked configurations with the second locking members (221,321). In the unlocked configurations, when the user ceases squeezing of the trigger members (230,330), the trigger members (230,330) are able to freely rotate about the hinges (233,333) away from the housings (220,320) by urging of the trigger member return springs (236,336), and in turn, the actuator members (250,350) that are operably-connected to the trigger members (230,330) are also moved in directions outwardly of the housings (220,320) from the ON positions in to the OFF positions.

The lock-off members (232,332) of the alternate embodiments (200,300) are forward rotatable to move the lock-off members from a non-locked-off position into a locked-off position, and, backwards rotatable from a non-locked-off position into a locked-off position respectively. The rotational axes around which the lock-off members (232,332) rotate are substantially perpendicular to elongate axes of the respective trigger members (230,330). When rotatably arranged in to the locked-off positions, the lock-off members (232,332) restrict movement of the trigger members (230, 330) relative to the housings (220,320) and whereby the actuator members (250,350) are restricted from being moved from the OFF positions in to the ON positions. When rotatably arranged in to the non-locked-off positions, the lock-off members (232,332) do not restrict movement of the trigger members (230,330) relative to the housings (220, 320) and whereby the actuator members (250,350) are not restricted from being moved towards the housings (220,320) from the OFF positions in to the ON positions. In these embodiments, the trigger assemblies include shaped-portions (242,342) disposed proximate to the housings (220, 320) which are configured to interact with the lock-off members (232,332) in such a manner that when the trigger members (230,330) are moved towards the housings (220, 320) with the lock-off members (232,332) rotatably arranged in to the locked-off positions, the actuator members (250,350) are restricted from being moved from the OFF positions in to the ON positions. For instance, the orientation of the lock-off members (232,332) when arranged in the locked-off positions may be configured such that the lock-off members (232,332) protrude downwardly and abut against engagement surfaces (244,344) in a manner whereby the trigger members (230,330) cannot be squeezed close enough to the respective housings (220,320) in order for the respective actuator members (250,350) to be moved from the OFF positions in to the ON positions. Conversely, when the lock-off members (232,332) are arranged in to the non-locked-off positions, the locked-off members (232,332) are oriented in such a way that they do not protrude downwardly and towards and abut against the engagement surfaces (244,344) and whereby the trigger members (230,330) are able to be squeezed close enough to the respective housings (220,320) in order for the respective actuator members (250,350) to be moved from the OFF positions in to the ON positions. The lock-off assemblies of these embodiments are configured to restrict movement of the trigger members (230,330) relative to the housings (220,320) when at least around 50 pounds of force is applied to the trigger members (230,330).

When the lock-off members (232,332) are rotated in to the locked-off positions, shaped-portions of the lock-off members (232,332) are configured for movement in to interference-fitting engagement with engagement surfaces (244, 344) disposed proximate the housings (220,320) whereby the lock-off members (232,332) are held in the locked-off positions by virtue of the interference-fitting engagement of the shaped-portions of the lock-off members (232,332) with the engagement surfaces (244,344). The shaped-portions of the lock-off members (230,330) may for instance include convex shape profiles. In other embodiments, other releasable engagement means may be utilised which need not necessarily involve interference fitting engagement. In certain embodiments, no interference-fitting engagement may be involved to releasably retain the lock-off members (232, 332) in their locked-off positions. Instead, a shaped-portions of the lock-off members (232,332) may be configured to hook or latch on to or around a corresponding shaped-portion disposed on the trigger members (230,330) or housings (220,320).

The lock-off members are configured to rotate about the hinges relative to the trigger members (230,330) within recesses (243,343) disposed in the trigger members, whereby when the lock-off members (233,332) are rotated in to the locked-off positions, portions of the lock-off members (232,332) protrudes outwardly of the recesses and when the lock-off members are rotated in to the non-locked-off positions, the lock off members (232,332) are configured to form substantially continuous surfaces with the trigger members (230,330) over the recesses (243,343). Advantageously, the protruding portions of the lock-off members (232,332) provide convenient levering means to lever the lock-off members (232,332) back in to their non-locked-off positions from the locked-off positions.

The trigger assemblies also include stoppers (241,341) disposed on the trigger members (230,330) that are configured for blocking rotation of the lock-off members (232,332) beyond predefined points of rotation about the hinges relative to the trigger members (230,330) when rotated from the non-locked-off positions in to the locked-off positions and/or when rotated from the locked-off positions in to the non-locked off positions. When the lock-off members (232,332) rotate in to contact with the respective stoppers (241,341) the lock-off members (232,332) may, in certain embodiments, also be configured for interference fitting engagement (or other suitable releasable engagement means within the functional context of the invention) with the stoppers (241,341) which may further assist in holding the lock-off members (232,332) in the locked-off positions.

The lock-off members (232,332) are biased in to the non-locked-off positions by biasing members (240,340) which in these embodiments are comprised by torsion springs (240,340). The biasing members (240,340) are suitably selected so that when the lock-off members (232,332) are arranged in to the locked-off positions, the interference fitting engagement is strong enough to releasably hold the lock-off members (232,332) in the locked-off positions notwithstanding the forces of the biasing members (240, 340) urging the lock-off members (232,332) towards the non-locked off positions. However, when the lock-off members (232,332) are arranged in the locked-off positions the user may apply a suitable amount of force (e.g. the user's finger pulling or pushing the protruding portions) in directions toward the non-locked off positions, the additional force that is applied is sufficient to disengage the lock-off members (232,332) from interference-fitting engagement so that the biasing members (240,340) may then freely urge the lock-off members (232,332) back in to their default non-locked-off positions. In these embodiments (200,300), the lock-off members (232,332) include concave portions within which the torsion springs (240,340) are able to be received and retained therein.

Advantageously, the lock-on and lock-off mechanisms are comprised by separate mechanisms that are independently operable. This provides a safety feature in that it reduces the risk of a user inadvertently activating the power tool by deactivating the lock-off mechanism.

In view of the above, it will be apparent that embodiments of the present invention herein described may assist in providing various advantages. In particular, the locking system conveniently provides both a lock-on and lock-off mechanism that are located proximate to each other such that the user may operate single-handedly and without having to adjust positioning of the user's hand. Furthermore, the lock-on and lock-off mechanisms are comprised by separate mechanisms that are independently operable. This provides a safety feature in that it reduces the risk of a user inadvertently activating the power tool by deactivating the lock-off mechanism. Yet further, in certain embodiments, as the lock-off mechanism may be slidably moved to either side of the central locked-off position, this may assist in accommodating both left-handed and right-handed users.

Those skilled in the art will appreciate that the invention described herein is susceptible to variations and modifications other than those specifically described without departing from the scope of the invention. All such variations and modification which become apparent to persons skilled in the art, should be considered to fall within the spirit and scope of the invention as broadly hereinbefore described. It is to be understood that the invention includes all such variations and modifications. The invention also includes all of the steps and features, referred or indicated in the specification, individually or collectively, and any and all combinations of any two or more of said steps or features.

The reference to any prior art in this specification is not, and should not be taken as, an acknowledgment or any form of suggestion that that prior art forms part of the common general knowledge.

What is claimed is:

1. A trigger assembly for use with an electrical device, said electrical device having an electric switch housing with an electrical switch unit disposed therein, the trigger assembly including;

a trigger member configured for movement relative to the housing;

an actuator member operably-connected to the trigger member and, responsive to movement of the trigger member relative to the housing, said actuator member being movable in a first direction relative to the housing from an OFF position in which the electrical switch is operably-opened by the actuator towards an ON position in which the electrical switch is operably-closed by the actuator, and movable in a second direction relative to the housing from the ON position towards the OFF position;

a lock-on mechanism including a first locking member mounted proximate to the trigger member and a second locking member mounted proximate to the housing, wherein when the actuator member is moved in to the ON position, said first and second locking members are selectably movable relative to each other into at least one of a locked configuration such that a first shaped portion of the first locking member releasably latches on to a suitably configured second shaped-portion of the second locking member, and the first shaped portion being configured to remain latched on to the second shaped-portion by urging of a return spring, whereby the actuator member is locked in to the ON position, and, an unlocked configuration whereby the actuator member is not locked in the ON position; and a lock-off mechanism including a lock-off member disposed on the trigger member, said lock-off member being rotatably movable about a first rotation axis between at least one of a locked-off position in which the lock-off member restricts movement of the trigger member relative to the housing and whereby the actuator member is restricted from being moved from the OFF position in to the ON position, and, a non-locked-off position in which the lock-off member does not restrict movement of the trigger member relative to the housing and whereby the actuator member is not restricted from being moved from the OFF position in to the ON position;

wherein the trigger assembly includes a shaped-portion disposed proximate to the housing wherein said shaped-portion is configured to abut against the lock-off member when the trigger member is moved towards the housing with the lock-off member rotatably arranged in to the locked-off position, whereby the actuator member is restricted from being moved from the OFF position in to the ON position; and wherein, said trigger assembly is characterised in that the lock-off member includes a torsion spring configured for urging the lock-off member towards the non-locked-off position, and wherein said lock-off member includes a concave portion within which the torsion spring is received therein.

2. A trigger assembly as claimed in claim 1 wherein said lock-on mechanism and lock-off mechanism are separate and independently operable of each other.

3. A trigger assembly as claimed in claim 1 wherein when the lock-off member is rotated in to the locked-off position, a shaped-portion of the lock-off member is configured for movement in to interference-fitting engagement with an engagement surface disposed on the trigger member or housing whereby the lock-off member is held in the locked-off position by the interference-fitting engagement of the shaped-portion of the lock-off member with the engagement surface.

4. A trigger assembly as claimed in claim 1 wherein the first rotation axis is substantially perpendicular to an elongate axis of the trigger member.

5. A trigger assembly as claimed in claim 1 wherein the lock-off member is configurable for rotational movement from the non-locked off position in to the locked-off position in either of a clockwise or an anti-clockwise direction about the first rotation axis.

6. A trigger assembly as claimed in claim 1 including at least one stopper disposed on the trigger member, said stopper being configured for blocking rotation of the lock-off member beyond a predefined point of rotation about the first rotation axis relative to the trigger member when rotated from the non-locked-off position in to the locked-off position and/or when rotated from the locked-off position in to the non-locked off position.

7. A trigger assembly as claimed in claim 1 wherein the lock-off member includes a biasing member configured for urging the lock-off member towards the non-locked-off position.

8. A trigger assembly as claimed in claim 1 wherein when the lock-off member is arranged in the locked-off position, it is configured to restrict movement of the trigger member relative to the housing when at least around 50 pounds of force is applied to the trigger member.

9. A trigger assembly as claimed in claim 1 wherein the lock-off member is configured to rotate about the first rotation axis relative to the trigger member within a recess disposed in the trigger member, whereby when the lock-off member is rotated in to the locked-off position a portion of the lock-off member protrudes outwardly of the recess and when the lock-off member is rotated in to the non-locked-off position, the lock off member is configured to form a substantially continuous surface with the trigger member over the recess.

10. A trigger assembly as claimed in claim 1 wherein the trigger member is hingedly coupled relative to the housing and includes a biasing member configured for biasing movement of the trigger member about the hinge whereby the actuator is urged towards the off position.

11. A trigger assembly as claimed in claim 1 wherein the first locking member of the lock-on mechanism is rotatably mounted to the trigger member and is configured for rotation in a first direction about a second rotation axis relative to the trigger member in to the locked configuration whereby the actuator member is locked in the ON position, and, in a second direction about the second rotation axis in to the unlocked configuration whereby the actuator member is not locked in the ON position.

12. A trigger assembly as claimed in claim 1 wherein the second rotation axis is substantially perpendicular to a direction of movement of the actuator.

* * * * *